United States Patent [19]

Bertsch

[11] Patent Number: 4,565,225

[45] Date of Patent: Jan. 21, 1986

[54] WEAVING MACHINE

[75] Inventor: Gotthilf Bertsch, Rüti, Switzerland

[73] Assignee: Maschinenfabrik Sulzer-Rüti AG, Rüti, Sweden

[21] Appl. No.: 642,542

[22] Filed: Aug. 20, 1984

[30] Foreign Application Priority Data

Sep. 1, 1983 [EP] European Pat. Off. ..... 83810397.6

[51] Int. Cl.[4] ..... D03D 47/48

[52] U.S. Cl. ..... 139/434

[58] Field of Search ..... 139/434, 439

[56] References Cited

U.S. PATENT DOCUMENTS 2,267,287 12/1941 Moessinger ..... 139/434

3,499,474 3/1970 Pfarrwaller ..... 139/434

3,750,716 8/1973 Kimura et al. ..... 139/439

*Primary Examiner*—Henry S. Jaudon

*Attorney, Agent, or Firm*—Werner W. Kleeman

[57] ABSTRACT

A blower nozzle is provided on the shot or weft insertion side of the weaving machine for blowing the severed end of the weft thread into an eyelet of a selvedge-tucking needle. By transferring the weft thread end by means of the blower nozzle, a particularly short time within the operating cycle of the weaving machine is required for the procedure of transferring the weft thread end to the selvedge-tucking needle. This permits higher operating speeds of the weaving machine.

7 Claims, 8 Drawing Figures

WEAVING MACHINE

BACKGROUND OF THE INVENTION

The present invention broadly relates to weaving machines and, more specifically, pertains to a new and improved construction of a weaving machine having a weft thread supply roll or cone which remains outside the weaving shed during weft insertion and from which weft thread is unwound during weft insertion as well as a selvedge-tucking needle for tucking ends of the weft thread which lie outside the weaving shed into a subsequent weaving shed.

In a known weaving machine of this type (cf. German Pat. No. 1,710,353, granted Mar. 2, 1972) the weft thread end is held by means of an edge thread clamp, is conducted over a selvedge-tucking needle having a hook and is subsequently laid into the weaving shed by the selvedge-tucking needle. The mechanical motion of the edge thread clamp and the subsequent transfer of the weft thread end to the selvedge-tucking needle requires a relatively long time within the operating cycle of the weaving machine. An increase in the operating speed of the weaving machine is limited by, among other things, this thread transfer procedure.

SUMMARY OF THE INVENTION

Therefore, with the foregoing in mind, it is a primary object of the present invention to provide a new and improved construction of a weaving machine which does not exhibit the aforementioned drawbacks and shortcomings of the prior art constructions.

Another and more specific object of the present invention aims at providing a new and improved construction of a weaving machine of the previously mentioned type wherein there is accomplished positive and reliable transfer of the weft thread ends to the selvedge-tucking needle by a fluid medium in a particularly short amount of time, thus permitting a higher operating speed of the weaving machine.

Yet a further significant object of the present invention aims at providing a new and improved construction of a weaving machine of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the weaving machine of the present invention is manifested by the features that it comprises an air nozzle for transferring the ends of the weft thread to the selvedge-tucking needle. The air nozzle is preferably a blower nozzle.

Practical experiments have shown that the weft thread end can be transferred in this manner to the selvedge-tucking needle in especially short time. By transferring the weft thread end to the selvedge-tucking needle by means of air, higher operating speeds of the weaving machine are made possible.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
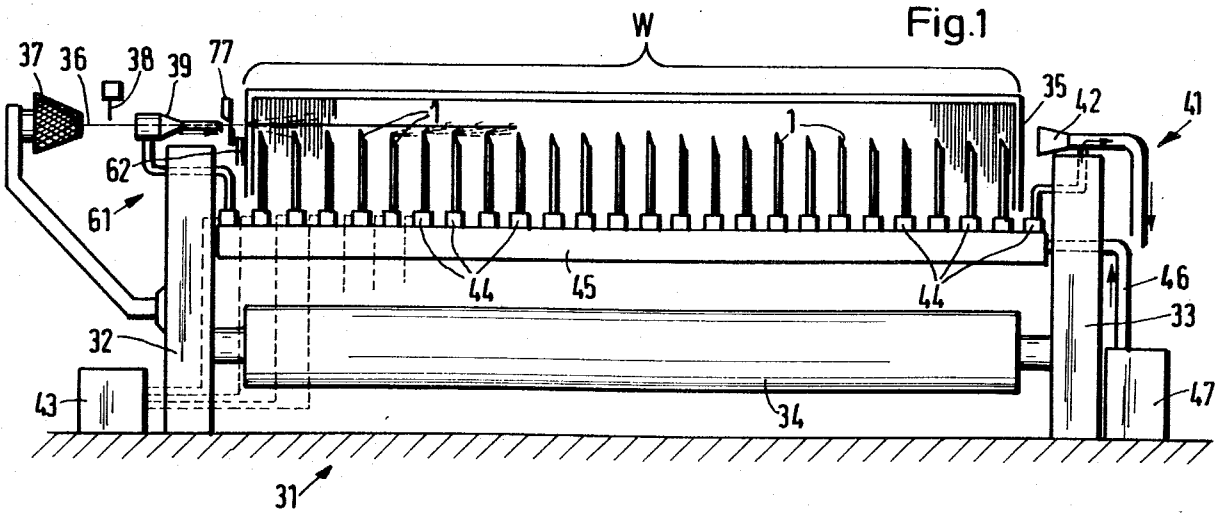
FIG. 1 schematically shows a pneumatic or air jet weaving machine seen from the woven fabric side.

Describing now the drawings, it is to be understood that, to simplify the showing thereof, only enough of the structure of the weaving machine has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a weaving machine 31 containing two machine end frames or cheek plates 32 and 33. A breast beam or fabric roll 34 and a weaving reed 35 are arranged between the end frames 32 and 33. The weft thread 36 is withdrawn or unwound from a stationary weft thread supply roll or cone 37, conducted through a weft thread tensioning device or brake 38 and blown into the weaving shed 65 by a main weft thread insertion nozzle 39 situated outside the weaving shed 65 having a weaving width W. Auxiliary nozzles 1 are distributed over the weaving width W and protrude into the weaving shed 65 during weft thread insertion. A suction nozzle 42 is arranged at the catch side 41.

The nozzles 39, 1 and 42 are, for instance, connected to an air distribution tube or manifold 45 by means of valves 44 controlled by an electronic control device 43. The air distribution tube or manifold 45 is supplied with air from any suitable air source such as a compressed air reservoir or container 47 by an air supply line or conduit 46. The reservoir or container 47 is maintained under pressure by a not particularly shown air compressor.

Figure 2:
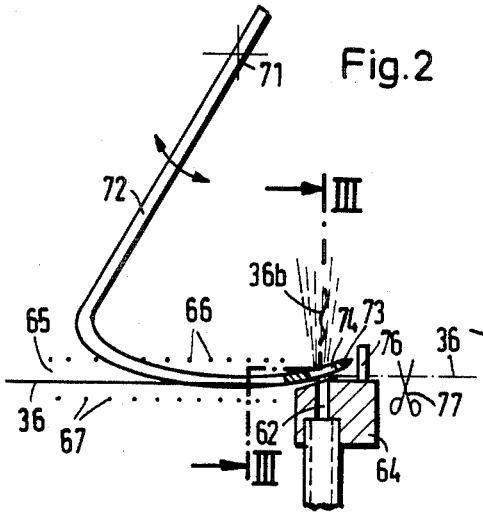
FIG. 2 shows an associated detail in section.
Figure 3:
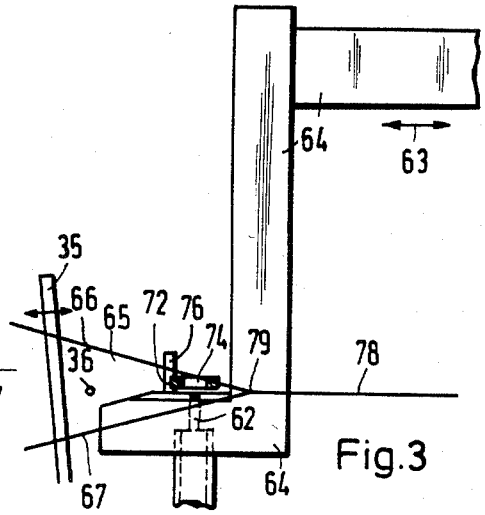
FIG. 3 is an elevational view taken in partial section along the line III—III in FIG. 2.

An air nozzle such as a blower nozzle 62 directed upwardly in FIGS. 1 to 3 is arranged at the shot or weft insertion side 61 and is mounted upon a carriage or carrier 64 oscillating in the direction of the double-headed arrow 63. The weaving shed 65 into which the weft thread 36 is inserted is formed by the upper shed warp threads 66 and the lower shed warp threads 67. There are furthermore present a number of edge warp threads 68 which fix or hold the weft thread ends **36*a***.

Figure 4:
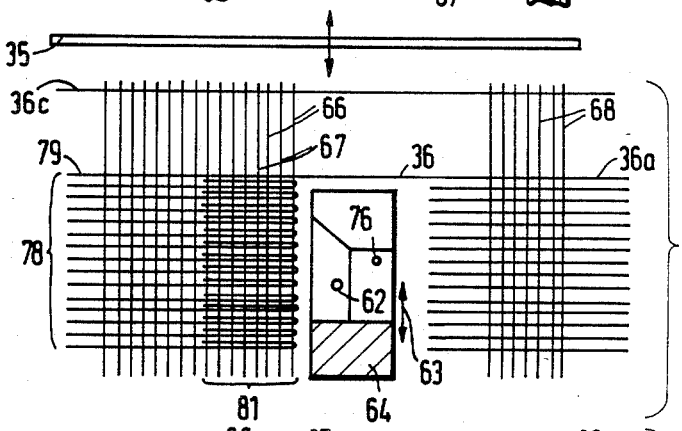
FIGS. 4 through 6 are each an associated plan view of the fabric or cloth being woven, partly schematic, at three different positions of the components.
Figure 5:
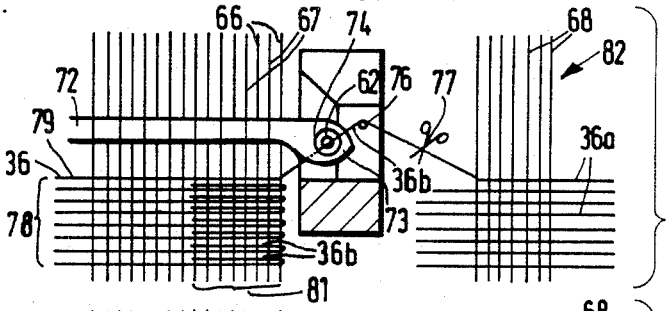

During the insertion of a given weft thread **36*c*, as shown in the upper portion of FIG. 4, the carriage 64 with the nozzle 62 is moved out of the forward inoperative motion-reversing position remote from the reed 35 as shown in FIG. 4 into the rearward operative motion-reversing position close to the reed 35 shown in FIG. 5. The free end 36*a* of the previously inserted weft thread 36 is fixed or clamped by means of the edge warp threads 68. A selvedge-tucking needle 72 is then inserted through the upper shed warp threads 66 from above while pivoting about the pivot point 71 according to FIG. 2. The tip or point 73 of the selvedge-tucking needle 72 contains an eyelet 74 whose diameter is greater than the diameter of the nozzle 62. The nozzle 62 is now positioned immediately beneath the eyelet 74 of the selvedge-tucking needle 72 as shown in FIG. 5. The weft thread 36 is guided by a substantially pin-shaped thread guide 76 fastened upon and moving with the carriage or carrier 64 over the nozzle 62 and is held under tension in this position. Now the weft thread 36 is severed by a suitable shear or cutter 77. Simultaneously, the nozzle 62 is supplied with blower air so that the weft thread end 36*b* is blown into the eyelet 74 of the selvedge-tucking needle 72 according to FIG. 2**.

Figure 6:
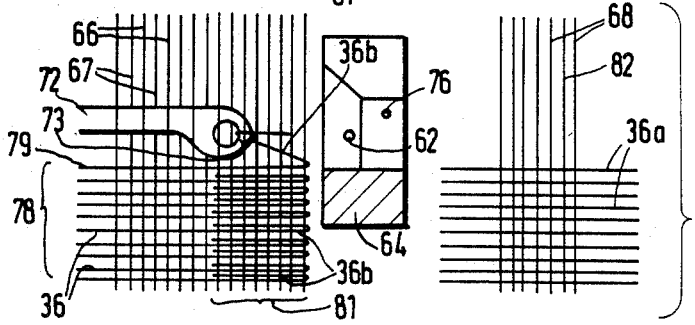

Subsequently, the selvedge-tucking needle 72 moves to the left according to FIG. 6, so that the weft thread end **36*b* is laid into the weaving shed 65. During this motion, the shed 65 is closed by not particularly shown weaving harnesses or equivalent structure and fixes or clamps the weft thread end 36*b*. Simultaneously, the reed 35 is pivoted to the right in FIG. 3 which beats-up the weft thread end 36*b* together with the weft thread 36*c* against the fell or edge 79 of the woven fabric 78**.

The selvedge-tucking needle 72 is in the meantime withdrawn from the shed 65, the blower air in the nozzle 62 is interrupted, the carriage or carrier 64 with the blower nozzle 62 is subsequently moved out of the rearward motion-reversing position (operative position) according to FIGS. 5 and 6 into the forward motion-reversing position (idle position) according to FIG. 4. The false selvedge 82 can now be removed. The machine is ready for the insertion of the weft thread subsequent to the previously inserted weft thread **36*c*. A laid-in or tucked-in listing or selvedge 81 is formed on the fabric or cloth 78** and forms the fabric edge or border thereof.

Figure 8:
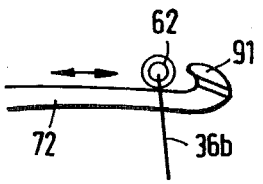
FIG. 8 illustrates a further embodiment of the invention.

In a modified embodiment, as shown in FIG. 8, the selvedge-tucking needle 72 has a hook 91 instead of an eyelet 74. The weft thread ends **36*b* are laid around the hook 91 by means of an appropriately arranged air nozzle such as the blower nozzle 62**.

An air nozzle such as the blower nozzle 62 for transferring the weft thread end **36*b* to the selvedge-tucking needle 72** is, by its nature, particularly well suited for pneumatic or air jet weaving machines in which compressed air is available in any case and in which especially high operating speeds are encountered.

In another modified embodiment, an air nozzle such as a blower nozzle 62 is provided on the catch side 41 for transferring the weft thread ends to a selvedge-tucking needle. In yet a further exemplary embodiment, a suction nozzle is used instead of the blower nozzle 62. The thread end **36*b* is sucked or drawn through the eyelet 74 of the selvedge-tucking needle 72** by the appropriately arranged suction nozzle.

Figure 7:
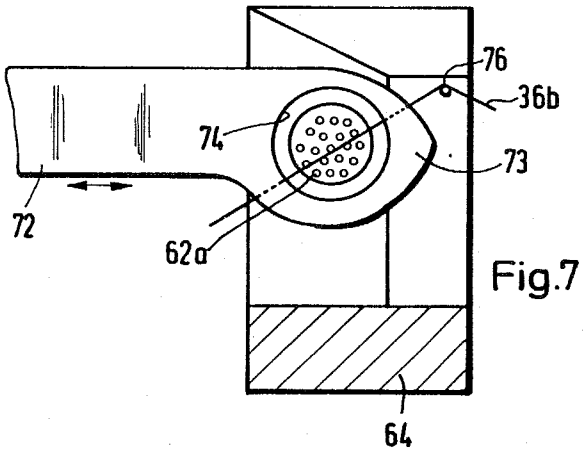
FIG. 7 is a plan view of a modified embodiment of the invention on an enlarged scale.

In yet another embodiment, a multiple-orifice nozzle **62*a* is employed as a blower nozzle according to the modified showing of FIG. 7. The multiple-orifice nozzle 62*a*** has a sieve-like arrangement of a plurality of basic nozzle orifices.

While there are shown and described present preferred embodiments of the invention, it is to be distinctly understood that the invention is not limited thereto, but may be otherwise variously embodied and practiced within the scope of the following claims. Accordingly,

I claim:

1. In a weaving machine, comprising:

a weft thread supply cone which remains outside a weaving shed during weft insertion;

weft threads being unwound from said weft thread supply cone during weft insertion;

a selvedge-tucking needle for tucking ends of the weft threads which lie outside the weaving shed into a subsequently formed weaving shed, the improvement which comprises:

an air nozzle for transferring said weft thread ends of said weft threads to said selvedge-tucking needle;

said selvedge-tucking needle having an outer free end; and an eyelet arranged at said outer free end for inserting each said weft thread end.

2. The weaving machine as defined in claim 1, wherein:

said air nozzle comprises a blower nozzle.

3. The weaving machine as defined in claim 2, wherein:

said blower nozzle comprises a multiple-orifice nozzle.

4. The weaving machine as defined in claim 1, wherein:

said air nozzle comprises a blower nozzle arranged at an edge of the fabric being woven; and said outer free end of said selvedge-tucking needle being conductable over said blower nozzle after entering the weaving shed for accepting the weft thread end of a weft thread.

5. In a weaving machine, comprising:

a weft thread supply cone which remains outside a weaving shed during weft insertion;

weft threads being unwound from said weft thread supply cone during weft insertion;

a selvedge-tucking needle for tucking ends of the weft threads which lie outside the weaving shed into a subsequently formed weaving shed, the improvement which comprises:

an air nozzle for transferring said weft thread ends of said weft threads to said selvedge-tucking needle;

said air nozzle comprising a blower nozzle;

a carrier oscillatable in a warp direction of a fabric being woven and controlled at the rhythm of the operating cycle of the weaving machine;

said blower nozzle being mounted on said carrier; and said blower nozzle being conducted to said selvedge-tucking needle by said carrier during transfer of the weft thread end of a weft thread.

6. The weaving machine as defined in claim 5, further including:

a weft thread guide mounted upon said carrier for guiding said weft thread to said blower nozzle.

7. A weaving machine, comprising:

a weft thread supply cone which remains outside a weaving shed during weft insertion;

weft threads being unwound from said weft thread supply cone during weft insertion;

an air nozzle;

a selvedge-tucking needle having a tip for tucking ends of the weft threads which lie outside the weaving shed back into a selvedge of a fabric being woven with the aid of said air nozzle;

said air nozzle defining a blower nozzle having a nozzle orifice;

an eyelet arranged at said tip of said selvedge-tucking needle and translatable over said nozzle orifice for blowing a free end of each weft thread inserted into the weaving shed into said eyelet;

a carrier movable in a predetermined warp direction;
a weft thread guide mounted on said carrier;
said blower nozzle being mounted on said carrier; and
said weft thread guide being arranged adjacent said blower nozzle so far ahead of said blower nozzle in a direction extending toward said weft threads that said free end of the inserted weft thread extends over said nozzle orifice after being deflected by said weft thread guide.

* * * * *

UNITED STATES PATENT AND TRADEMARK OFFICE

CERTIFICATE OF CORRECTION

PATENT NO. : 4,565,225

DATED : January 21, 1986

INVENTOR(S) : GOTTHILF BERTSCH

It is certified that error appears in the above—identified patent and that said Letters Patent is hereby corrected as shown below:

In item [73] at the first page, please delete "Sweden" and insert --Switzerland--

Signed and Sealed this

*First* Day of *April 1986*

[SEAL]

*Attest:*

DONALD J. QUIGG

*Attesting Officer*

*Commissioner of Patents and Trademarks*